US005842831A

United States Patent [19]

Galke et al.

[11] Patent Number: 5,842,831

[45] Date of Patent: Dec. 1, 1998

[54] ARRANGEMENT FOR THE THERMAL PROTECTION OF A ROTOR OF A HIGH-PRESSURE COMPRESSOR

[75] Inventors: Volkmar J. Galke, Zürich; Pierre Meylan, Neuenhof; Uy-Liem Nguyen, Baden, all of Switzerland

[73] Assignee: Asea Brown Boveri AG, Baden, Switzerland

[21] Appl. No.: 822,920

[22] Filed: Mar. 21, 1997

[30] Foreign Application Priority Data

Apr. 19, 1996 [DE] Germany ..... 196 15 549.5

[51] Int. Cl.[6] ..... F01D 5/08; F01D 5/32

[52] U.S. Cl. ..... 416/95; 416/198 A; 416/215

[58] Field of Search ..... 415/138, 139, 415/176–178; 416/95, 198 A, 200 A, 201 R, 241 R, 248, 215, 216, 217, 218, 190, 191; 403/28, 32, 404

[56] References Cited

U.S. PATENT DOCUMENTS

| | | | |
|---|---|---|---|
| 2,772,854 | 12/1956 | Anxionnaz | 416/190 |
| 3,143,383 | 8/1964 | Bamberger et al. . | |
| 5,232,336 | 8/1993 | Baer et al. | 416/198 A |
| 5,308,227 | 5/1994 | Gros et al. | 416/198 A |
| 5,630,702 | 5/1997 | Marmillic et al. | 415/177 |

FOREIGN PATENT DOCUMENTS

| | | | |
|---|---|---|---|
| 0139396 | 5/1985 | European Pat. Off. . | |
| 43-17121 | 7/1977 | Japan | 416/95 |
| 55-23320 | 2/1980 | Japan | 416/191 |
| 626947 | 12/1981 | Switzerland . | |

*Primary Examiner*—Christopher Verdier
*Attorney, Agent, or Firm*—Burns, Doane, Swecker & Mathis, L.L.P.

[57] ABSTRACT

An arrangement for the thermal protection of a rotor, fitted with moving blades, of a high-pressure compressor. The roots of the moving blades are inserted and locked in peripheral grooves which are at an axial distance from one another. The rotor has, between two adjacent peripheral grooves for the moving blades, at least one further peripheral groove having a hook extending over the entire periphery of the rotor. At least two plate-shaped heat-accumulation segments, each having at least one root which has a contour adapted to the hook of the rotor so that both form a contact area, are pushed radially one after the other into the further peripheral groove and locked therein. A cavity forming an insulating layer extends between the heat-accumulation segments and the rotor and between the moving-blade roots and the rotor, in which insulating layer the velocity of the compressor air is greatly reduced.

10 Claims, 4 Drawing Sheets

ARRANGEMENT FOR THE THERMAL PROTECTION OF A ROTOR OF A HIGH-PRESSURE COMPRESSOR

BACKGROUND OF THE INVENTION

1. Field of the Invention

The invention relates to the field of combustion technology. It relates to an arrangement for the thermal protection of the rotor of a high-pressure compressor which is integrated, for example, in a gas-turbine plant.

2. Discussion of Background

It is common practice in gas turbines for the areas of the blade carrier and of the shaft which are not covered by the blades to be protected from the hot combustible gases by means of heat-accumulation segments. In this case, the heat-accumulation segments are pushed with their roots into peripheral grooves in the rotor and are fastened there.

Hitherto, heat-accumulation segments were not necessary at the compressor rotor, since the pressure conditions there were relatively moderate (e.g. 15 bar) and thus the temperatures in the compressor were not extremely high. Consequently, no strength problems with the rotor material arose.

However, due to the present exacting economic and ecological requirements, higher and higher efficiencies are aimed at in modern thermal turbomachines, for example gas turbines, which, inter alia, also leads to higher pressure and temperature conditions in the compressor. For example, pressures at a level of 30 bar are realized nowadays. Without countermeasures, these pressures can be realized only with expensive, temperature-resistant material.

SUMMARY OF THE INVENTION

Accordingly, one object of the invention, in attempting to avoid all these disadvantages, is to provide a novel arrangement for the thermal protection of the rotor of a thermal turbomachine, in particular a high-pressure compressor, which arrangement is relatively simple and cost-effective to produce and with which it is possible, without great changes to the compressor moving blades and while using the known fastening technique (roots), to achieve adequate protection of the rotor from excessive temperatures so that, for example, ferritic material can be used for the compressor rotor disks.

According to the invention, this is achieved in that, in an arrangement according to the preamble of claim 1, the rotor has, between two adjacent peripheral grooves for the moving blades, at least one further peripheral groove having at least one hook extending over the entire periphery of the rotor, and in each case at least two plate-shaped heat-accumulation segments having at least one root which has a contour adapted to the hook of the rotor and can be pushed radially into the further peripheral groove and locked therein, a cavity for an insulating layer being provided between the heat-accumulation segments and the rotor and between the moving-blade roots and the rotor.

To be regarded as the advantages of the invention, inter alia, are that the high-pressure compressor rotor does not have to be cooled in a costly manner and that, despite the high pressure conditions, relatively inexpensive ferritic material can be used for the rotor disks. The heat-accumulation segments can be easily mounted in the peripheral grooves or removed therefrom. The arrangement is space-saving and uses the known and proven fastening technique by means of roots. Therefore expensive additional milling operations can be dispensed with; this is because the peripheral grooves are recessed into the rotor. The roots of the rotor heat-accumulation segments are pressed against the rotor hooks by the centrifugal acceleration in such a way that the contact area between rotor and segment is reduced and an insulating layer of air is produced between the two. At the same time, the flow of the hot insulating layer is prevented in the direction of flow by the roots bearing against the rotor hooks.

It is especially expedient if the rotor has, between two adjacent peripheral grooves for the moving blades, in each case two hooks extending over the entire periphery of the rotor, and the heat-accumulation segments each have two roots adapted to the contour of the hooks. As a result, the heat-accumulation segments have especially good seating.

Furthermore, it is advantageous if in each case 8 to 24, preferably 16, heat-accumulation segments are arranged in a peripheral groove in the rotor. This number has proved to be especially favorable for reasons of ease of mounting.

Finally, each heat-accumulation segment is advantageously locked by means of a radial fastening pin. This can be realized at little cost.

In addition, it is of advantage if the two end faces of the heat-accumulation segment are slanted at an angle in the range of 30° up to and including 60°, preferably 45°, the two end faces, facing one another, of two adjacent heat-accumulation segments are arranged parallel to one another, and, when the arrangement is mounted, a small intermediate space is provided in the cold state between two adjacent heat-accumulation segments. During operation, the ends of the adjacent heat-accumulation segments can then slide one upon the other as a result of the thermal expansion.

Further configuration variants are contained in the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a high-pressure compressor rotor for a gas-turbine plant, wherein.

Only the elements essential for understanding the invention are shown. Elements of the plant which are not shown are, for example, the blade carrier and the compressor casing. The direction of flow of the working media is designated by arrows.

DESCRIPTION OF THE PREFERRED EMBODIMENTS

Figure 1:
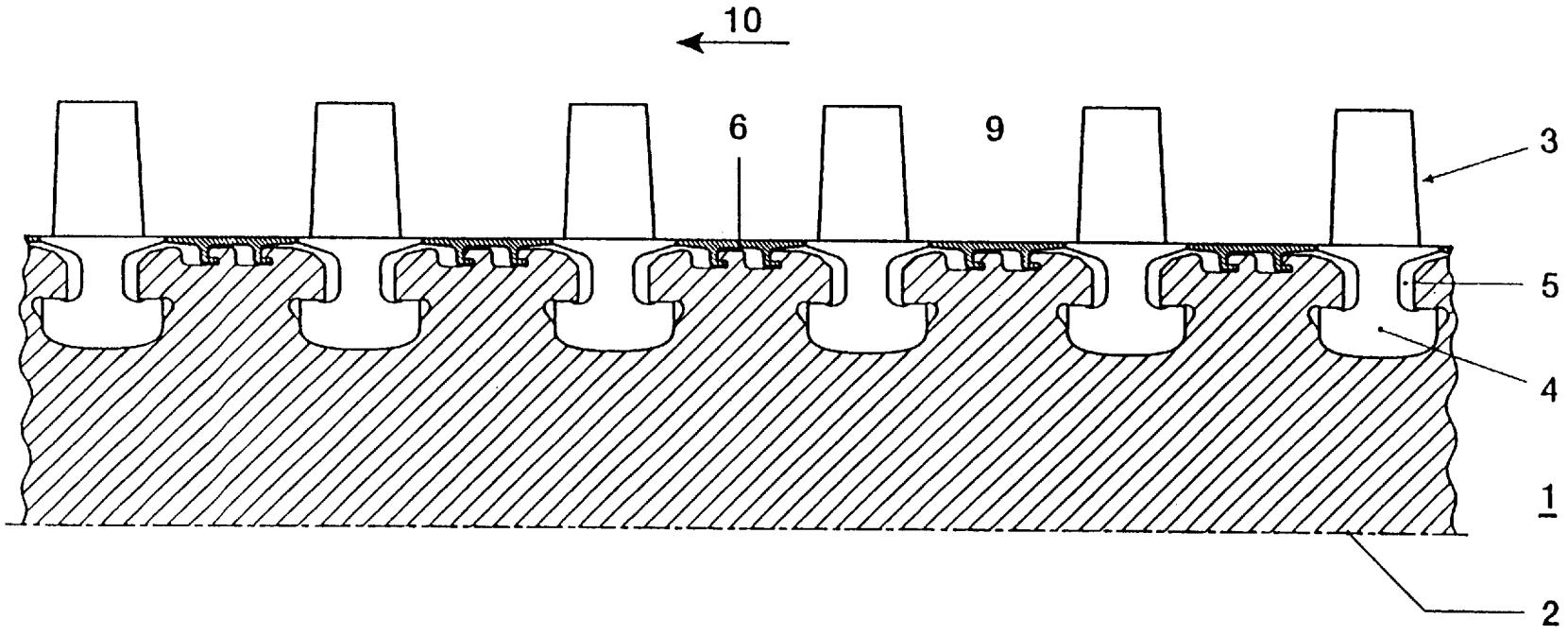
FIG. 1 shows a partial longitudinal section of the last six stages of the high-pressure compressor rotor.

Referring now to the drawings, wherein like reference numerals designate identical or corresponding parts throughout the several views, FIG. 1 shows in a partial longitudinal section the last six stages of a high-pressure compressor rotor 1 which provides the compressed air for the combustion chamber of a gas turbine or for cooling the turbine. In the present example, the compressor is designed for a pressure of 30 bar and it has 22 compressor stages.

The rotor 1 rotates about a longitudinal axis 2. It is provided with moving blades 3 in each of the 22 stages, which moving blades 3, are pushed by their roots 4, into peripheral grooves 5 of the rotor 1 and locked therein, which peripheral grooves 5 have been recessed into the rotor 1. Heat-accumulation segments 6, which are described in more detail in the following FIGS. 2 to 5, are arranged between every two adjacent rows of blades of the high-pressure compressor rotor 1.

On the parts of the rotor surface which are not covered with the moving blades 3, the heat-accumulation segments 6 form a ring and protect the high-pressure compressor rotor 1 at these locations from excessive thermal stressing by the hot air 10 flowing along in the flow passage 9. For mounting reasons, in each case at least two, preferably 8 to 24, heat-accumulation segments 6 are arranged per ring, i.e. over the periphery. If 16 heat-accumulation segments are used, mounting and removal is especially simple to realize.

Figure 2:
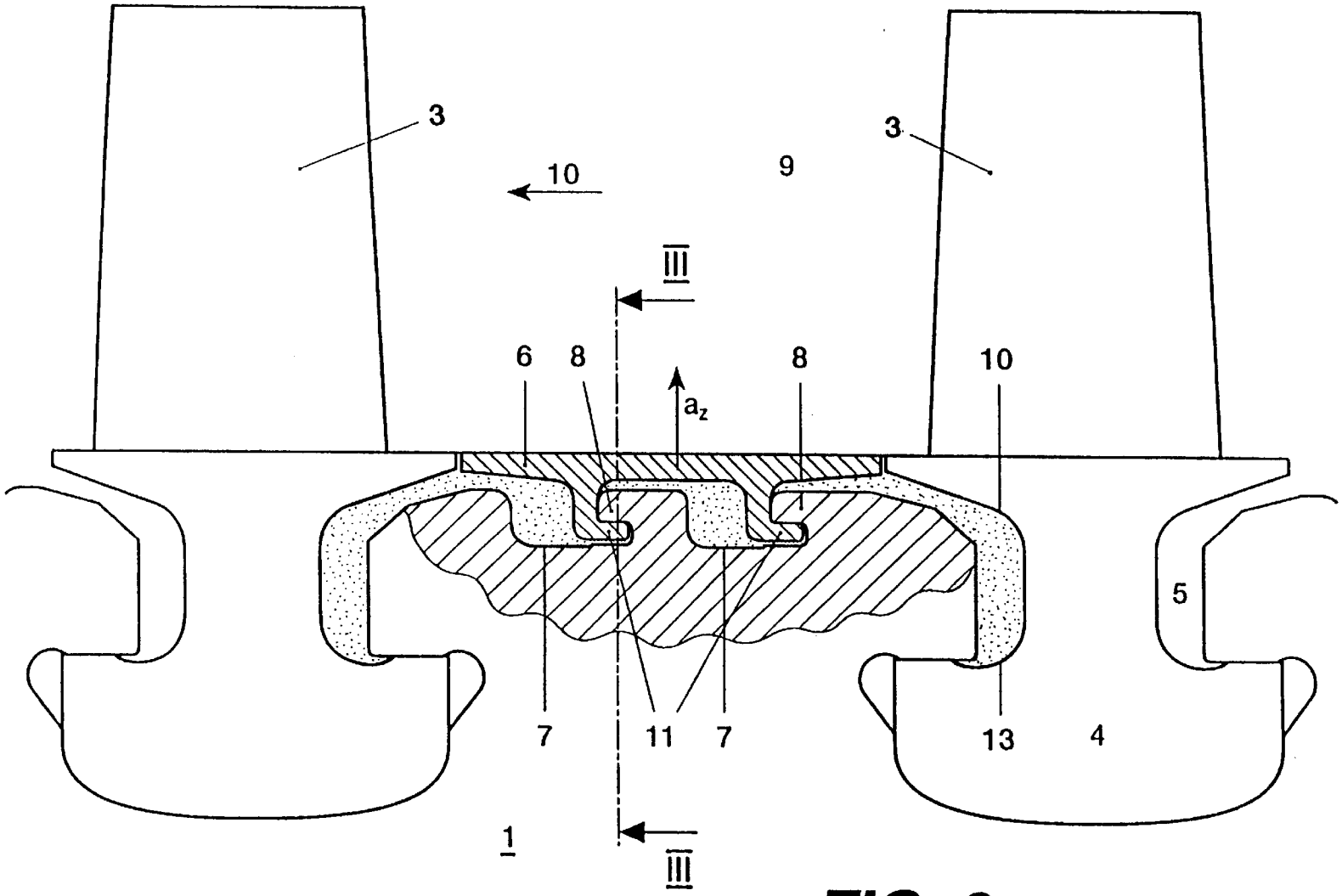
FIG. 2 shows a partial longitudinal section of the rotor with heat-accumulation segment.

FIG. 2 shows, in a partial longitudinal section, an enlarged detail of FIG. 1 in the region of the heat-accumulation segment 6 arranged between two compressor moving blades 3. The moving blades 3 are arranged with their roots 4 in recessed peripheral grooves 5 of the rotor 1. In this exemplary embodiment, two further peripheral grooves 7, which can likewise be produced by means of recessing, are provided in the rotor 1 between two adjacent peripheral grooves 5 for the moving blades 3. These peripheral grooves 7 are each bounded by a rotor hook 8 extending over the entire periphery of the rotor 1 as well as by the plate-shaped heat-accumulation segments 6. The heat-accumulation segments 6 have two segment roots 11 on their lower side remote from the flow passage 9 for the hot air 10, each root 11 projecting into one of the peripheral grooves 7. The shapes of the segment root 11 and of the rotor hook 8 are matched to one another in such a way that, when pushed radially into the peripheral groove 7, the root 11 of the heat-accumulation segment 6, when pushed radially into the peripheral groove 7, more or less forms a contact area with the rotor hook 8. The heat-accumulation segments 6 of the compressor are thus radially inserted and locked like the compressor moving blades 3.

When the compressor rotates about the axis 2, that is during operation, the roots 11 of the rotor heat-accumulation segments 6 are pressed against the recessed rotor hooks 8 by the centrifugal acceleration $a_z$ in such a way that the contact area between the rotor 1 and the heat-accumulation segment 6 is reduced and, as a result, the cavity 13 between the heat-accumulation segments 6 and the rotor 1 is enlarged, which cavity 13, together with the cavity present between the moving-blade roots 4 and the rotor 1, is provided for an insulating layer. The velocity of the compressor air 10 is greatly reduced in this insulation layer, since the flow of the hot insulating layer is prevented in the direction of flow by the segment roots 11 bearing against the rotor hooks 8.

On account of the insulating layer present and on account of the cooling area enlarged by the secondary surface, the rotor 1 is protected from excessive temperatures. It does not have to be cooled in a costly manner. The very high pressure conditions can readily be ensured. In addition, relatively inexpensive materials, for example ferritic steel, can be used. The arrangement acccording to the invention serves as a rotor heat shield and is relatively simple and cost-effective to produce. It is space-saving and easy to remove and mount. In addition, recourse is made to known and proven fastening techniques (roots).

Figure 3:
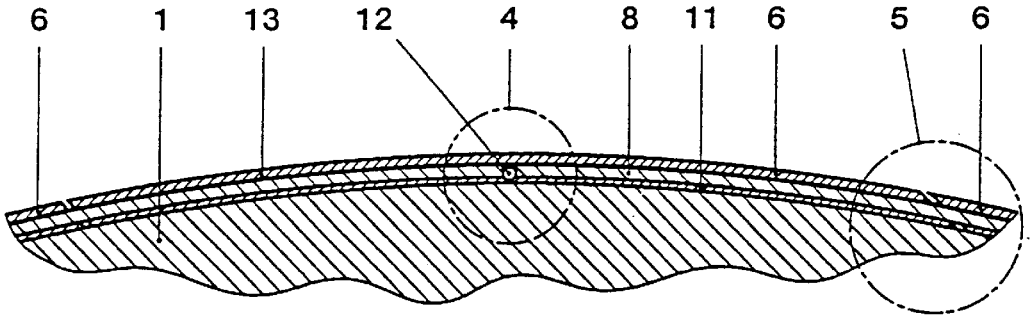
FIG. 3 shows a partial cross section in the plane III—III according to FIG. 2.
Figure 4:
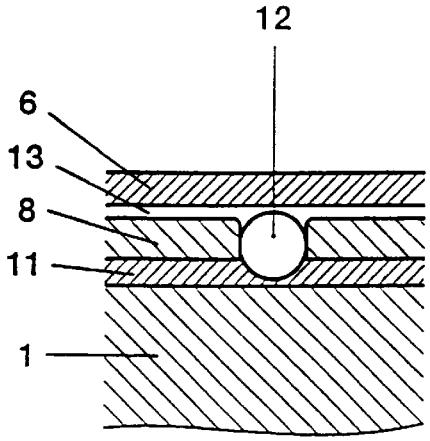
FIG. 4 shows an enlarged detail of FIG. 3 in the region of the fastening pin.
Figure 5:
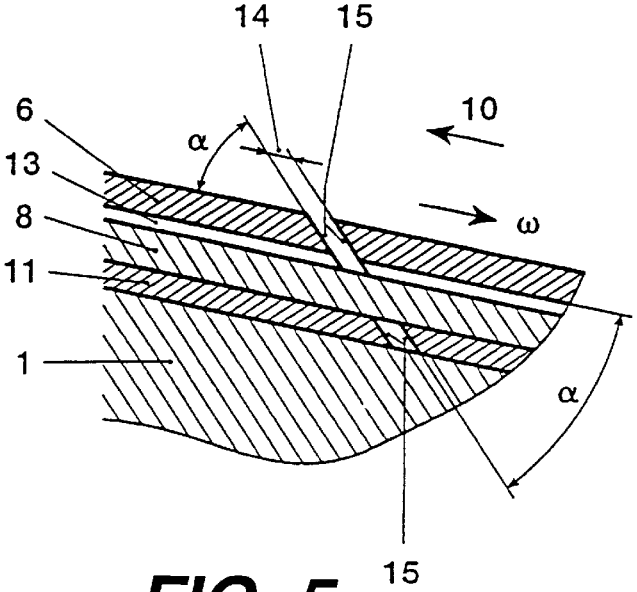
FIG. 5 shows an enlarged detail of FIG. 3 in the end region of two adjacent heat-accumulation segments.

FIG. 3 shows a partial cross section of the rotor 1 counter to the direction of flow according to FIG. 2 in the plane III—III, whereas in FIGS. 4 and 5 enlarged details of FIG. 3 are shown in the region of the radial fastening pin 12 (FIG. 4) and in the region of the ends of two adjacent heat-accumulation segments 6 (FIG. 5).

In FIG. 3, three heat-accumulation segments 6, of which only the center one is depicted completely, are indicated in section counter to the direction of flow. The "interlocking" of the segment roots 11 with the rotor hook 8 is clearly evident. The radial fastening pin 12 is arranged in the center of the heat-accumulation segment 6. It serves to lock the heat-accumulation segment 6. This can be seen especially clearly in the enlarged representation of a detail according to FIG. 4.

The region of the ends of two adjacent heat-accumulation segments 6 is shown in detail in FIG. 5. The ends of the heat-accumulation segment 6 in the peripheral direction are slanted at an angle $\alpha$ of 45°, specifically in such a way that two parallel end faces 15 are obtained for each heat-accumulation segment 6 and, on the other hand, these end faces 15 are also formed parallel to the end faces 15 of the adjacent heat-accumulation segment 6. In order to prevent the hot air 10 from being able to pass too easily under the heat-accumulation segments 6, the end faces 15 of the heat-accumulation segments 6, must be slanted in comparison with the direction of flow of the air 10 and the direction of rotation $\omega$ of the rotor, as shown in FIG. 5, i.e. the intermediate space 14 between the adjacent heat-accumulation segments 6 must be oriented counter to the direction of flow of the air.

According to the invention, when the heat-accumulation segments 6 are mounted, an intermediate space 14 is provided in the cold state between the end faces 15 of two adjacent heat-accumulation segments 6. This has the advantage that, during operation, the end faces 15 of the heat-accumulation segments can slide one upon the other unproblematically as a result of the thermal expansion.

The invention is, of course, not restricted to the exemplary embodiment just described. Thus, for example, the angle $\alpha$ may be within the following range: $30° \leqq \alpha \leqq 60°$.

Figure 6:
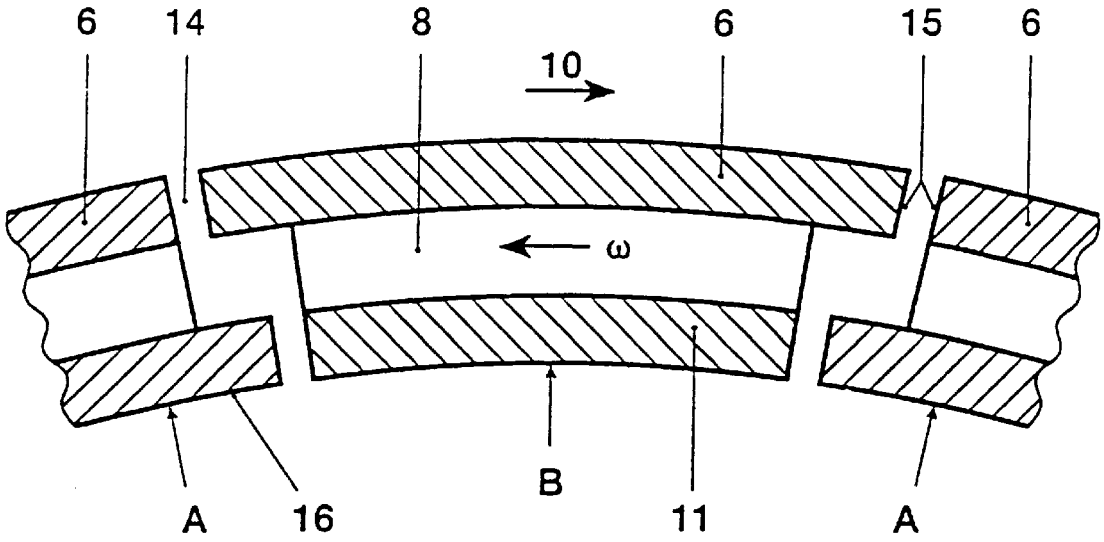
FIG. 6 shows another embodiment variant of the invention.
Figure 7:
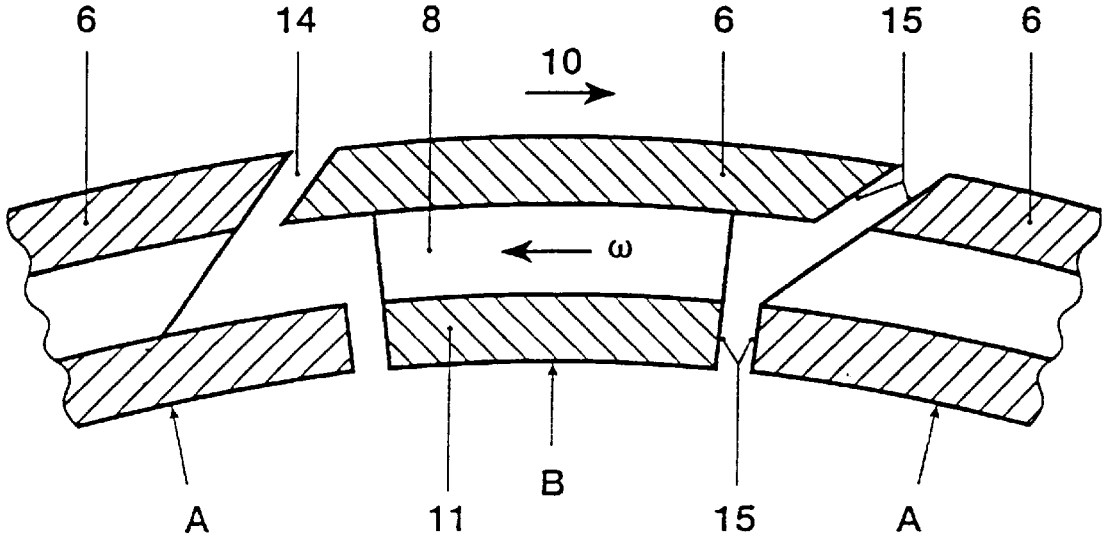
FIG. 7 shows a further embodiment variant of the invention.

Further embodiment variants of the invention are shown in FIG. 6 and FIG. 7. FIG. 6 and FIG. 7 each show three adjacent heat-accumulation segments 6 of a peripheral row, A and B in each case designating heat-accumulation segments 6 of a row which are of different geometric configuration.

In contrast to the embodiment variant according to FIG. 5, in FIG. 6 the ends of the heat-accumulation segments are not slanted. However, the end faces 15 of adjacent heat-accumulation segments A, B are likewise formed parallel to one another. The heat-accumulation segments A and B are in each case arranged alternately over the periphery of the rotor 1. An offset 16 serves to facilitate mounting.

FIG. 7 shows an embodiment variant in which heat-accumulation segments A and B, likewise of different geometric configuration, are arranged alternately over the periphery of the rotor 1. In this case, the end faces 15 are only partly slanted. In a similar way to FIG. 6, they are not slanted in the region of the segment roots 11.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An arrangement for thermal protection of a rotor of a high-pressure compressor, said rotor being fitted with moving blades having roots, said arrangement comprising:

peripheral grooves formed in the rotor at an axial distance from one another, the moving blade roots being inserted and locked in said peripheral grooves, at least one further peripheral groove formed in the rotor between two adjacent said peripheral grooves for the moving blades, said at least one further peripheral groove having at least one hook extending over an entire periphery of the rotor, at least two plate-shaped heat-accumulation segments each having at least one root which has a contour adapted to the hook of the rotor and which can be pushed radially into the further peripheral groove and locked therein, and a cavity forming an insulating layer extending between the heat-accumulation segments and the rotor and between the moving-blade roots and the rotor.

2. The arrangement as claimed in claim 1, wherein said at least one hook of the further peripheral groove, between the two adjacent said peripheral grooves for the moving blades, includes two hooks extending over the entire periphery of the rotor, and the at least one root of the heat-accumulation segments includes two roots adapted to the contour of the hooks.

3. The arrangement as claimed in claim 1, wherein said at least two heat-accumulation segments includes eight to twenty-four heat-accumulation segments arranged over the periphery of the rotor.

4. The arrangement as claimed in claim 1, further comprising a radial fastening pin for each heat-accumulation segment, said heat-accumulation segment being locked by means of said radial fastening pin.

5. The arrangement as claimed in claim 1, wherein each said heat-accumulation segment includes two end faces which are slanted at an angle ($\alpha$) in the range of $30°-\leqq\alpha\leqq 60°$, two of said end faces, facing one another, of two adjacent heat-accumulation segments are arranged parallel to one another.

6. The arrangement as claimed in claim 1, wherein each said heat-accumulation segment includes two end faces which are only partly slanted at an angle ($\alpha$) in the range of $30°-\leqq\alpha\leqq 60°$, two of said end faces, facing one another, of two adjacent heat-accumulation segments are arranged parallel to one another.

7. The arrangement as claimed in claim 5, wherein, when the arrangement is mounted, an intermediate space is provided in a cold state between the end faces, facing one another, of two adjacent heat-accumulation segments.

8. The arrangement as claimed in claim 5, wherein the angle ($\alpha$) is approximately 45°.

9. The arrangement as claimed in claim 6, wherein the angle ($\alpha$) is approximately 45°.

10. The arrangement as claimed in claim 1, wherein at least a portion of said cavity extends circumferentially relative to the rotor.

* * * * *